US007606513B2

(12) United States Patent
Lee

(10) Patent No.: US 7,606,513 B2
(45) Date of Patent: Oct. 20, 2009

(54) IMAGE-FORMING APPARATUS INCLUDING A DEVICE TO ATTACH AND DETACH A TRANSFER ROLLER FROM A MAIN BODY FRAME THEREOF

(75) Inventor: Hyun-ho Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 468 days.

(21) Appl. No.: 11/387,913

(22) Filed: Mar. 24, 2006

(65) Prior Publication Data

US 2006/0225592 A1 Oct. 12, 2006

(30) Foreign Application Priority Data

Apr. 6, 2005 (KR) ..... 10-2005-0028514

(51) Int. Cl.
*G03G 15/08* (2006.01)

(52) U.S. Cl. ..... 399/121

(58) Field of Classification Search ..... 399/107, 399/110, 121
See application file for complete search history.

(56) References Cited

U.S. PATENT DOCUMENTS

2002/0021916 A1* 2/2002 Wakana ..... 399/121

FOREIGN PATENT DOCUMENTS

| | | |
|---|---|---|
| JP | 04-288572 | 10/1992 |
| JP | 09-236990 | 9/1997 |
| KR | 2000-34986 | 6/2000 |
| KR | 2001-4136 A | 1/2001 |
| KR | 2004-9168 | 1/2004 |
| KR | 2005-3875 A | 1/2005 |

* cited by examiner

*Primary Examiner*—David M Gray
*Assistant Examiner*—Joseph S Wong
(74) *Attorney, Agent, or Firm*—Stein McEwen, LLP

(57) ABSTRACT

An image-forming apparatus including a device to attach/detach a transfer roller that attaches and detaches the transfer roller to a main body frame, and the device to attach/detach a transfer roller supports one end of a transfer roller axis to rotate with respect to the main body frame and separates the end of the transfer roller axis from the main body frame by ascending and descending the end of the transfer roller axis in a slanting direction.

34 Claims, 9 Drawing Sheets

IMAGE-FORMING APPARATUS INCLUDING A DEVICE TO ATTACH AND DETACH A TRANSFER ROLLER FROM A MAIN BODY FRAME THEREOF

CROSS-REFERENCE TO RELATED APPLICATIONS

This application claims the benefit of Korean Patent Application No. 10-2005-0028514, filed on Apr. 6, 2005, in the Korean Intellectual Property Office, the disclosure of which is incorporated herein in its entirety by reference.

BACKGROUND OF THE INVENTION

1. Field of the Invention

Aspects of the present invention relate to an image-forming apparatus, and more particularly, to an image-forming apparatus having a device to attach/detach a transfer roller from a main body of the image-forming apparatus.

2. Description of the Related Art

Generally, an image-forming apparatus prints a desired image on a sheet of print medium by: forming an electrostatic latent image on a photosensitive medium using an exposing unit, such as a laser scanning unit; developing the electrostatic latent image into a toner image using toner; and transferring and fixing the toner image onto the sheet of print medium by applying heat and pressure thereto.

Thus, the image-forming apparatus comprises a transfer roller that rotates in contact with the photosensitive medium to transcribe the toner image onto the sheet of print medium. The transfer roller is detachably mounted to the main body and can be easily replaced with a new one.

FIG. 1 is a perspective view illustrating a conventional transfer roller assembled to a main body, and FIG. 2 is a perspective view illustrating an operation for assembling the transfer roller of FIG. 1 to a main body.

Referring to FIGS. 1 and 2, a transfer roller 10 is supported by a circular supporting unit 31 and a hemispherical supporting unit 32 disposed on a main body frame 30. Each of the ends 11*a* and 11*b* of a transfer roller axis 11 of the transfer roller 10 is supported to rotate by the circular supporting unit 31 and the hemispherical supporting unit 32.

The end 11*a* of the transfer roller axis 11 is inserted into a circular bushing 21, and the circular bushing 21 is supported by the circular supporting unit 31. The other end 11*b* of the transfer roller axis 11 is rotatably supported by a fixing unit 40 which is disposed on the main body frame 30 and inserted into the hemispherical supporting unit 32.

As depicted in FIG. 2, the fixing unit 40 is designed to deform elastically when the other end 11*b* of the transfer roller axis 11 is pushed downward from an upper side. When the other end 11*b* of the transfer roller axis 11 is inserted into the hemispherical supporting unit 32, the fixing unit 40 returns to an original position and restricts the other end 11*b* of the transfer roller axis 11 from moving upward.

To mount the transfer roller 10 to the main body frame 30, the fixing unit 40 is elastically deformed by pressing the other end 11*b* of the transfer roller axis 11 downward from an upper side. To separate the transfer roller 10 from the main body frame 30, the other end 11*b* of the transfer roller axis 11 is lifted after releasing it from the fixing unit 40 by elastically pressing the fixing unit 40 using a tool or by hand.

Therefore, when the transfer roller 10 is mounted to the main body frame 30, an assembling space must be secured, and when the transfer roller 10 is separated from the main body frame 30 to replace it by a new one, the separation operation is difficult due to a small area of the assembling space.

SUMMARY OF THE INVENTION

Aspects of the present invention provide an image-forming apparatus comprising a device that facilitates the replacement of a transfer roller.

According to an aspect of the present invention, there is provided an image-forming apparatus comprising: a photosensitive medium on which a toner image is formed; a transfer roller that transcribes the toner image onto a sheet of print medium; and a device to attach/detach the transfer roller to a main body frame of the image-forming apparatus, wherein the device to attach/detach the transfer roller is mounted to slide with respect to the main body frame, supports one end of a transfer roller axis to rotate with respect to the main body frame, and separates the end of the transfer roller axis from the main body frame by ascending and descending the end of the transfer roller axis in a direction vertical to the sliding direction.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
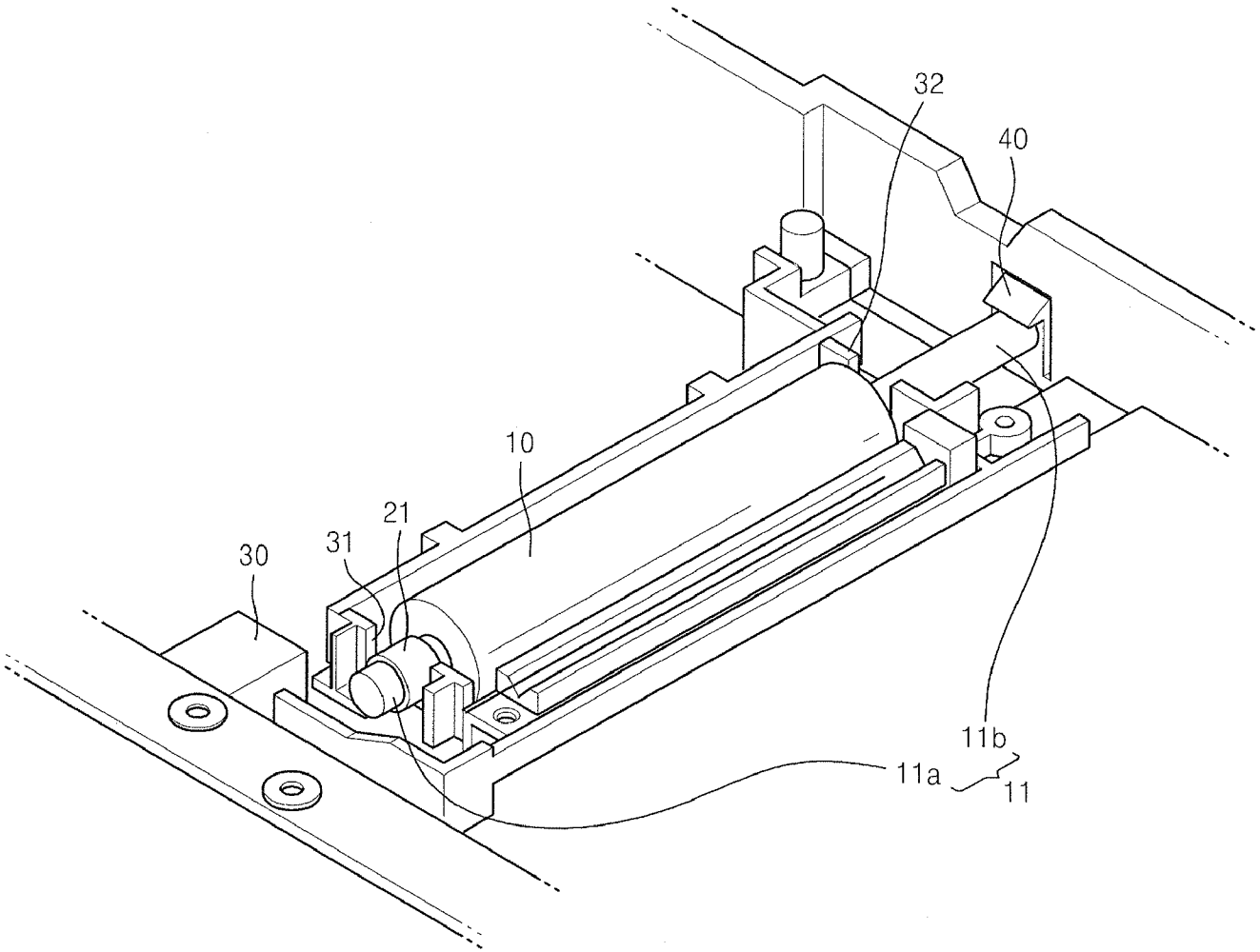
FIG. 1 (RELATED ART)
FIG. 1 is a perspective view illustrating a prior art transfer roller mounted to a main body.
Figure 2:
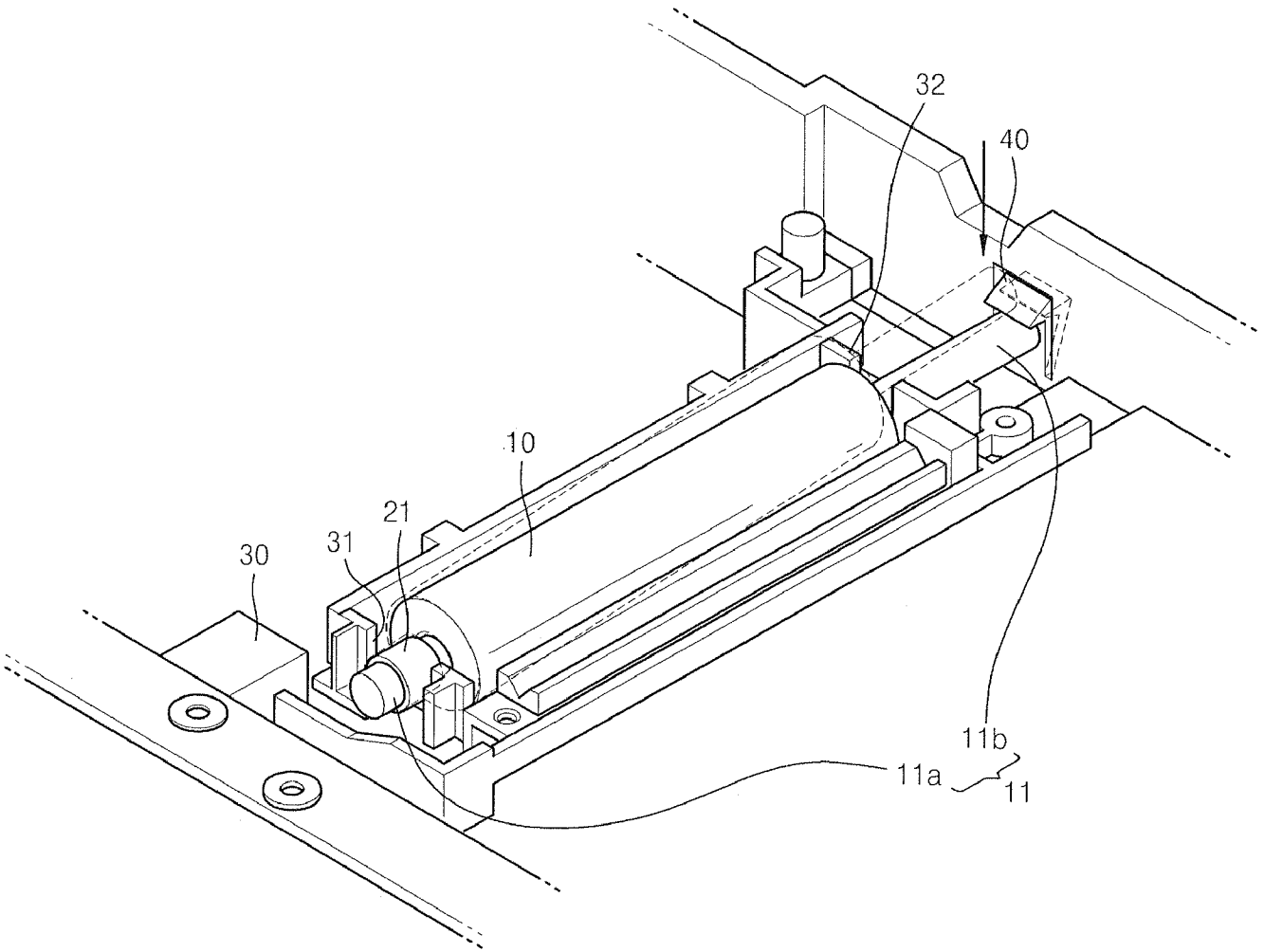
FIG. 2 (RELATED ART)
FIG. 2 is a perspective view illustrating an operation of mounting the transfer roller of FIG. 1 to a main body.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
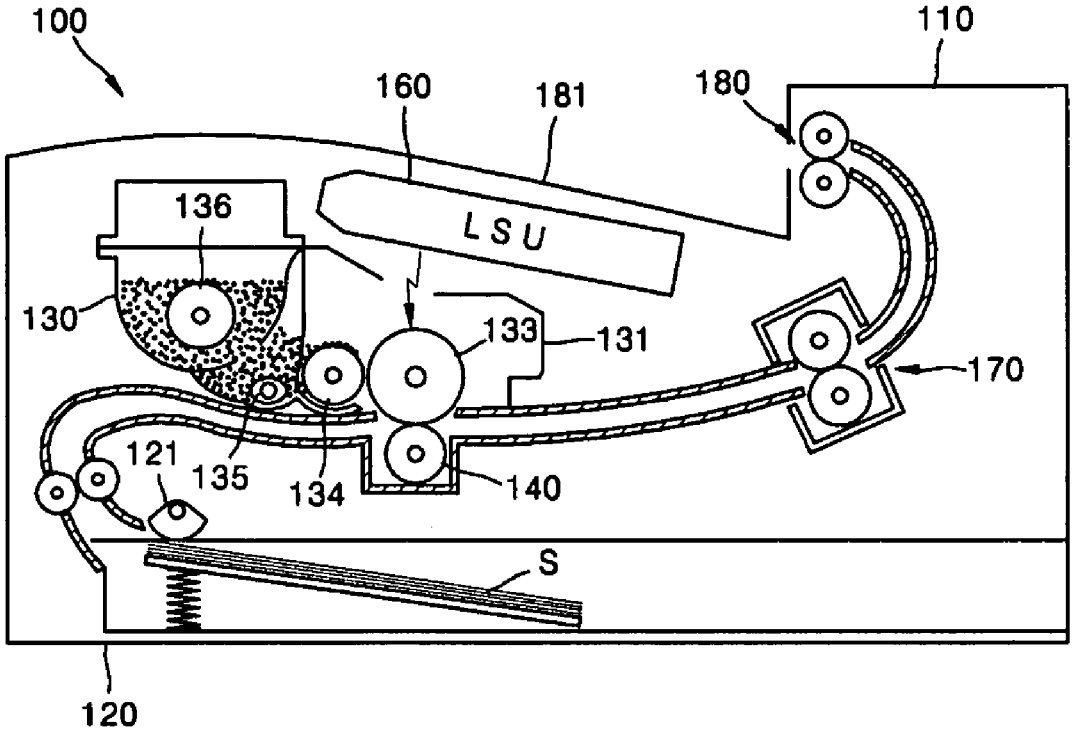
FIG. 3 is a lateral cross-sectional view illustrating an image-forming apparatus comprising a device to attach/detach a transfer roller from a main body frame of the image-forming apparatus according to an embodiment of the present invention.
Figure 4:
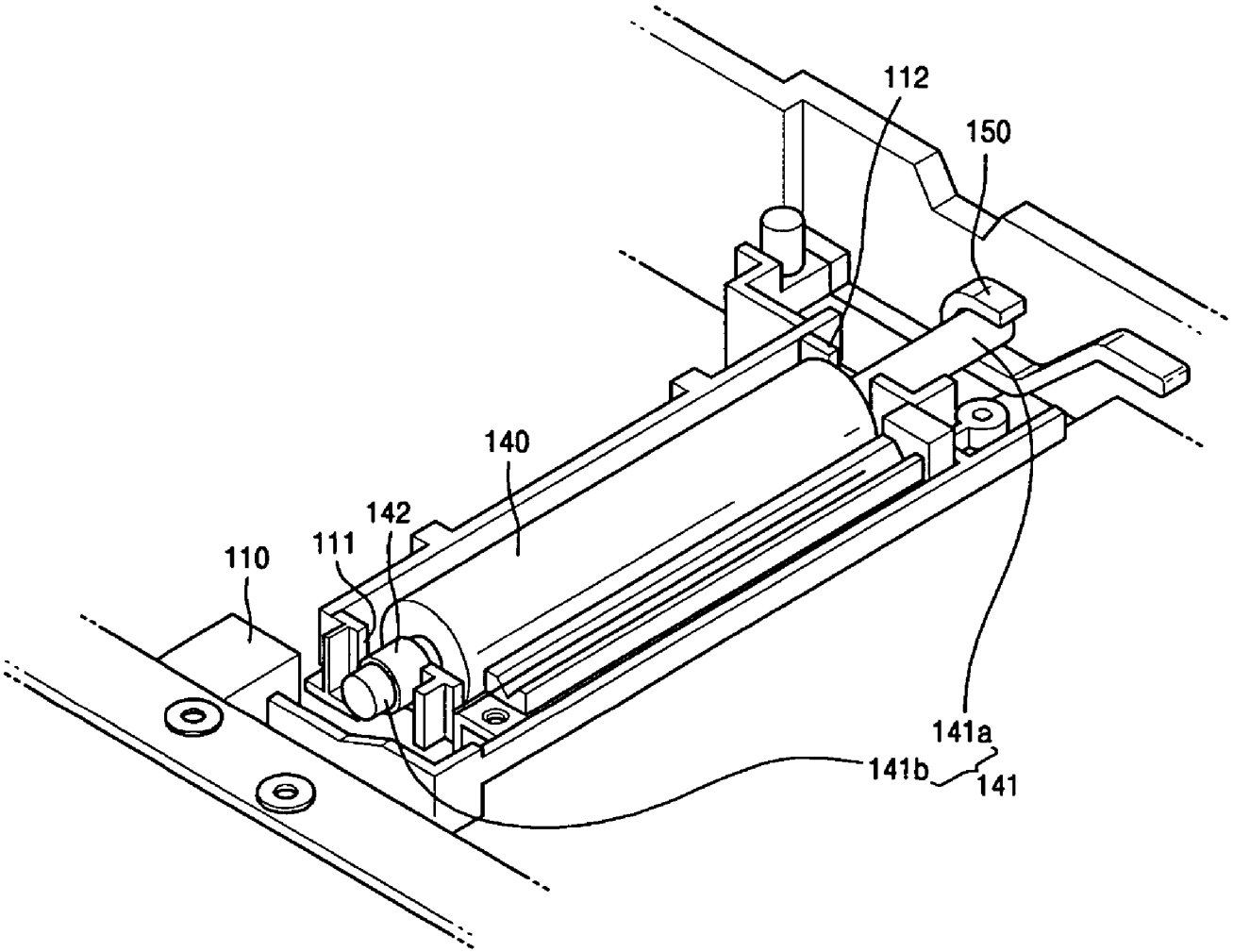
FIG. 4 is a perspective view illustrating a transfer roller mounted to a main body frame of the image-forming apparatus of FIG. 3.

Referring to FIG. 3 and FIG. 4, an image-forming apparatus 100 comprises a cassette 120, a developing unit 130, a transfer roller 140, a fixing unit 170, and print media discharge rollers 180.

The cassette 120 holds sheets of print media S and is detachably mounted to a main body frame 110. A pick-up roller 121 for picking up the print medium S is mounted in an upper part of the cassette 120 and rotates in the main body frame 110.

The developing unit 130 is detachably mounted to the main body frame 110 and develops an electrostatic latent image formed on a photosensitive drum 133 into a toner image. The developing unit 130 comprises a photosensitive drum 133 mounted in a housing 131 on which an electrostatic latent image is formed, a developing roller 134 that develops the electrostatic latent image using a toner, a supply roller 135 that supplies the toner to the developing roller 134, and a mixing roller 136 that mixes the toner to prevent the toner from hardening.

A portion of the photosensitive drum 133 protrudes outside the housing 131, and an electrostatic latent image corresponding to image digital signals is formed on an outer circumference of the photosensitive drum 133 by light irradiated from an exposing unit 160, such as a laser scanning unit.

The transfer roller 140 is mounted to contact the photosensitive drum 133 and transfer a toner image formed on a surface of the photosensitive drum 133 to a sheet of print medium S by pressing the sheet of print medium S that passes between the photosensitive drum 133 and the transfer roller 140.

Other types of print media S aside from paper, such as transparencies, overheads, etc., may be used.

The transfer roller 140 comprises a transfer roller axis 141. An end 141*a* of the transfer roller axis 141 is rotatably supported by a hemispherical supporting unit 112 disposed on the main body frame 110 and an other end 141*b* of the transfer roller axis 141, which is inserted into a circular bushing 142, is rotably supported by a circular supporting unit 111 disposed on the main body frame 110.

The fixing unit 170 fixes the toner image transcribed on a sheet of print medium S, and comprises a pressing roller that presses the toner image onto the sheet of print medium S and a heating roller that generates heat and applies the heat to the toner image.

The print media discharge rollers 180 discharge the sheet of print medium S on which the toner image is fixed to the outside of the main body frame 110. The sheets of print media S discharged by the print media discharge roller 180 are sequentially stacked on a print media deck 181 disposed on an upper part of the main body frame 110.

Figure 5:
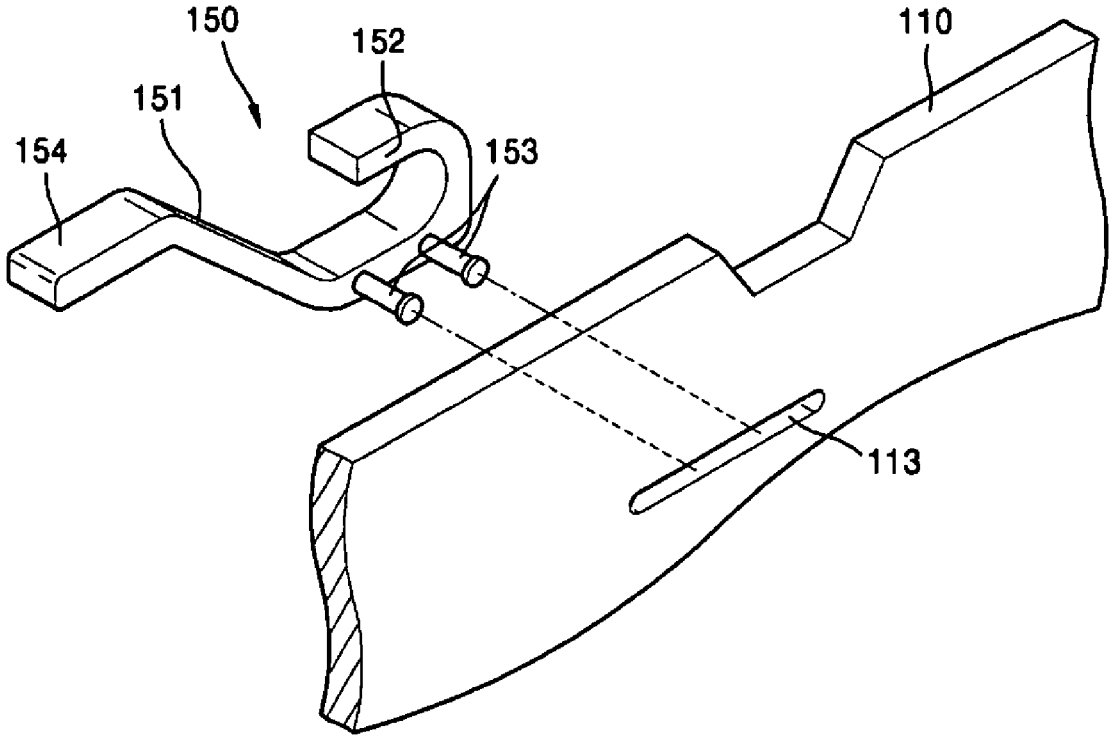
FIG. 5 is a perspective view illustrating the configuration of the device to attach/detach a transfer roller of FIG. 4.

Referring to FIGS. 4 and 5, a device 150 to attach/detach the transfer roller 140 easily attaches/detaches the transfer roller 140 to/from the main body frame 110 since the device 150 for attaching/detaching the transfer roller 140 is mounted to slide in a print media transferring direction with respect to the main body frame 110, and is connected to a slant unit 151, a locking unit 152, and a lever unit 154.

The slant unit 151 is inclined at a predetermined angle and the end 141*a* of the transfer roller axis 141 slides on the slanting unit 151 when the device 150 to attach/detach a transfer roller slides.

The locking unit 152 has a "C" shape and the open side of the "C" shape faces the slanting unit 151. The locking unit 152 supports and prevents the end 141*a* of the transfer roller axis 141 from deviating upward, i.e., in a vertical direction with respect to the print media transferring direction.

A plurality of sliding protrusion units 153 are formed on an end of the locking unit 152. The sliding protrusion units 153 are mounted to slide in a sliding hole 113 formed in the main body frame 110.

Various modifications of sliding protrusion units besides the sliding protrusion units 153 described above can be applied to the present invention if the device 150 to attach/detach a transfer roller can slide with respect to the main body frame 10 in a print media transferring direction.

Figure 6:
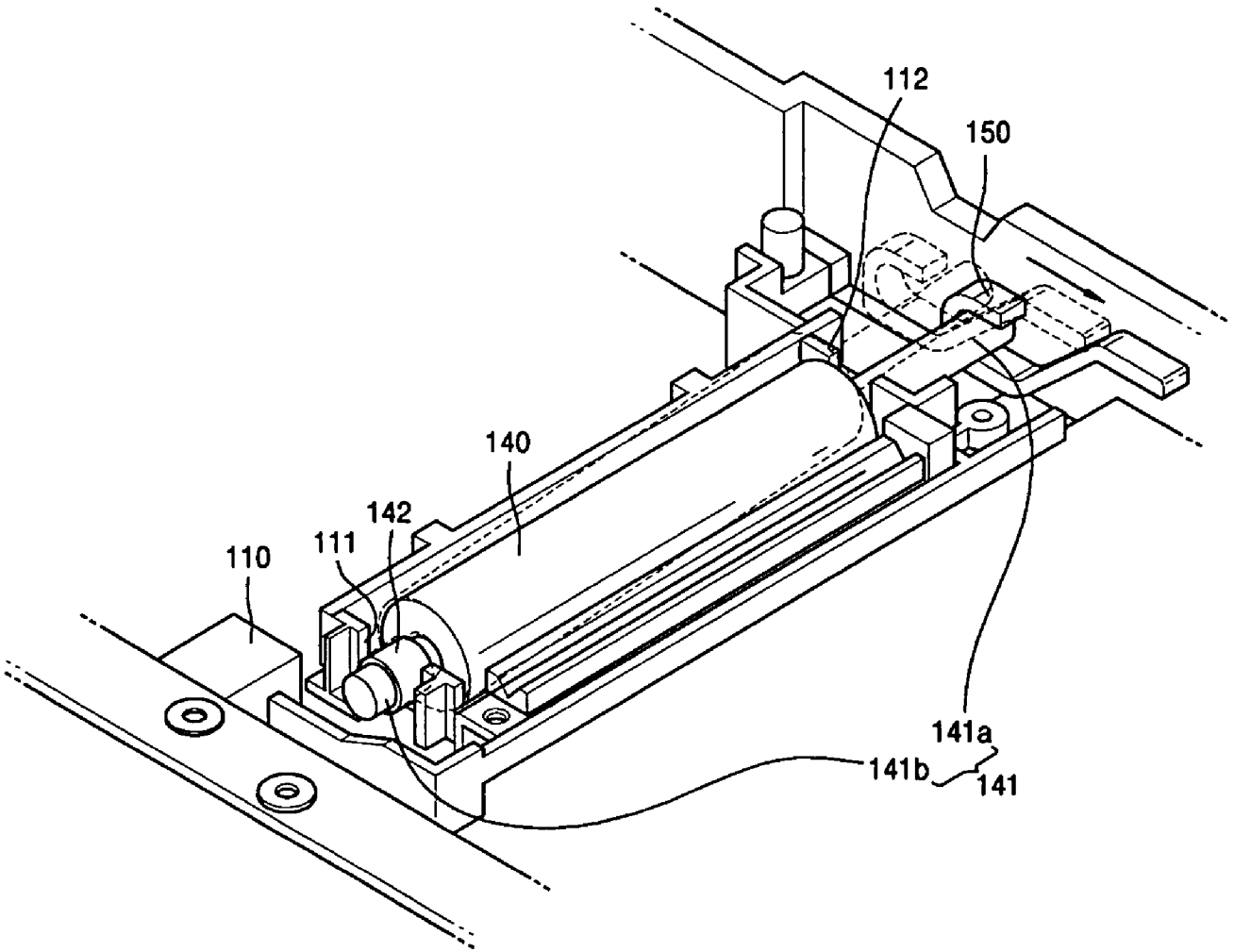
FIG. 6 is a perspective view illustrating a mounting operation of a transfer roller to a main body frame of the image-forming apparatus of FIG. 3.
Figure 7:
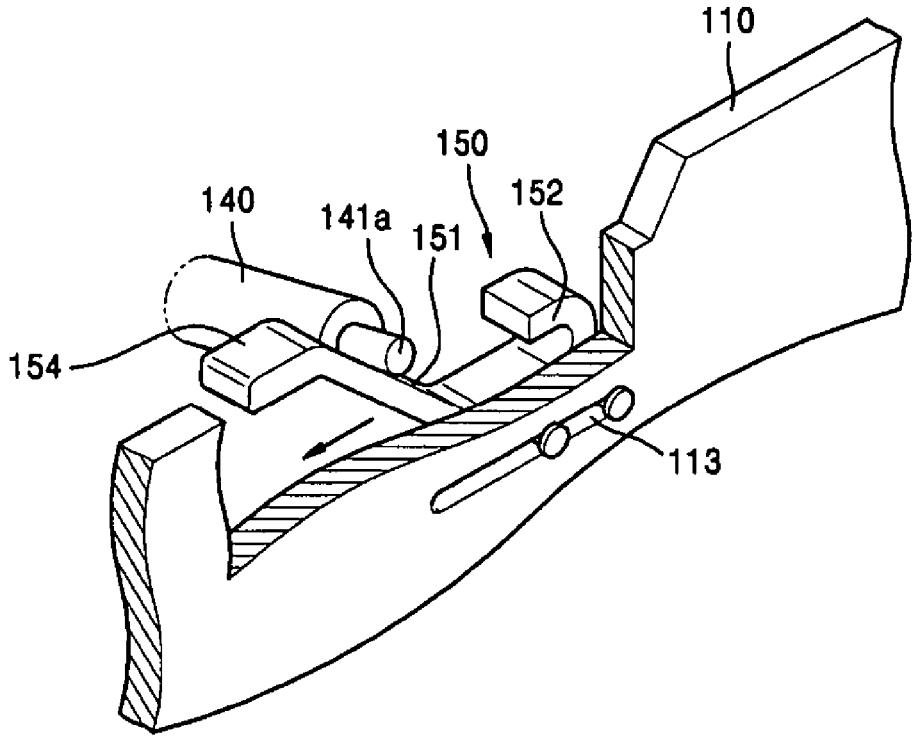
FIG. 7 is a perspective view illustrating an attaching operation of a device to attach/detach a transfer roller when the transfer roller is attached to a main body frame of the image-forming apparatus of FIG. 3.

Referring to FIGS. 6 and 7, an operation of mounting the transfer roller 140 to the main body frame 110 will now be described.

After inserting the other end 141*b* of the of the transfer roller axis 141 into the circular supporting unit 111, the end 141*a* of the transfer roller axis 141 is placed on the slanting unit 151 of the device 150 to attach/detach the transfer roller 140 indicated by dotted lines.

When the user pulls the lever unit 154 in a direction indicated by the arrow, the device 150 to attach/detach the transfer roller 140 moves along the sliding hole 113 in a direction indicated by the arrow by the sliding protruding units 153, and the end 141*a* of the transfer roller axis 141 moves downward in a vertical direction with respect to the print media transferring direction by sliding on the slanting unit 151.

The end 141*a* of the transfer roller axis 141 that has slid down the slanting unit 151 is inserted into the hemispherical supporting unit 112 and is restricted to move upward by the locking unit 152.

An operation of separating the transfer roller 140 from the main body frame 110 will now be described.

Figure 8:
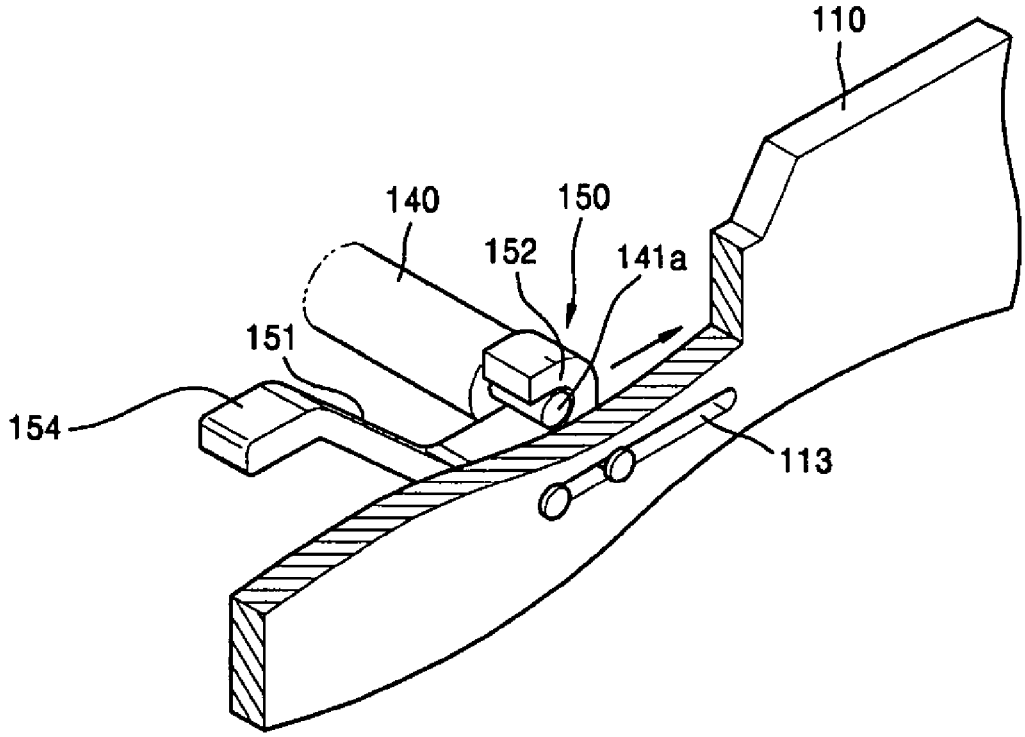
FIG. 8 is a perspective view illustrating a detaching operation of a device to attach/detach a transfer roller when the transfer roller is detached from a main body frame of the image-forming apparatus of FIG. 3.

Referring to FIGS. 6 and 8, when the user pushes the lever unit 154 in a direction indicated by the arrow shown in FIG. 8, the end 141*a* of the transfer roller axis 141 moves upward in a vertical direction with respect to the print media transferring direction after separating from the locking unit 152 by sliding along the slanting unit 151.

Then, the end 141*a* of the transfer roller axis 141 comes out from the hemispherical supporting unit 112 so that it can be caught by a hand.

The transfer roller 140 is separated from the main body frame 110 by holding the end 141*a* of the transfer roller axis 141.

Figure 9:
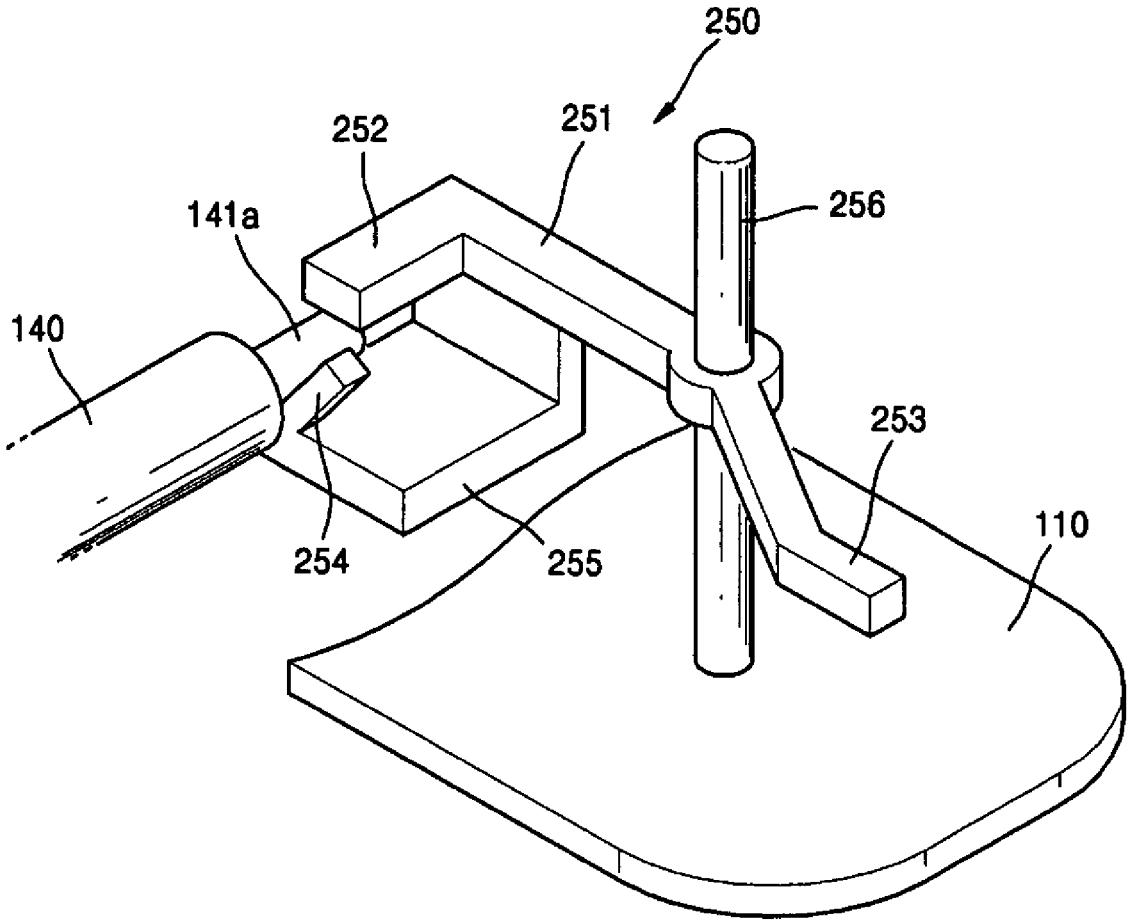
FIGS. 9 and 10 are perspective views illustrating attaching/detaching operations of an image-forming apparatus having a device to attach/detach a transfer roller according to another embodiment of the present invention.
Figure 10:
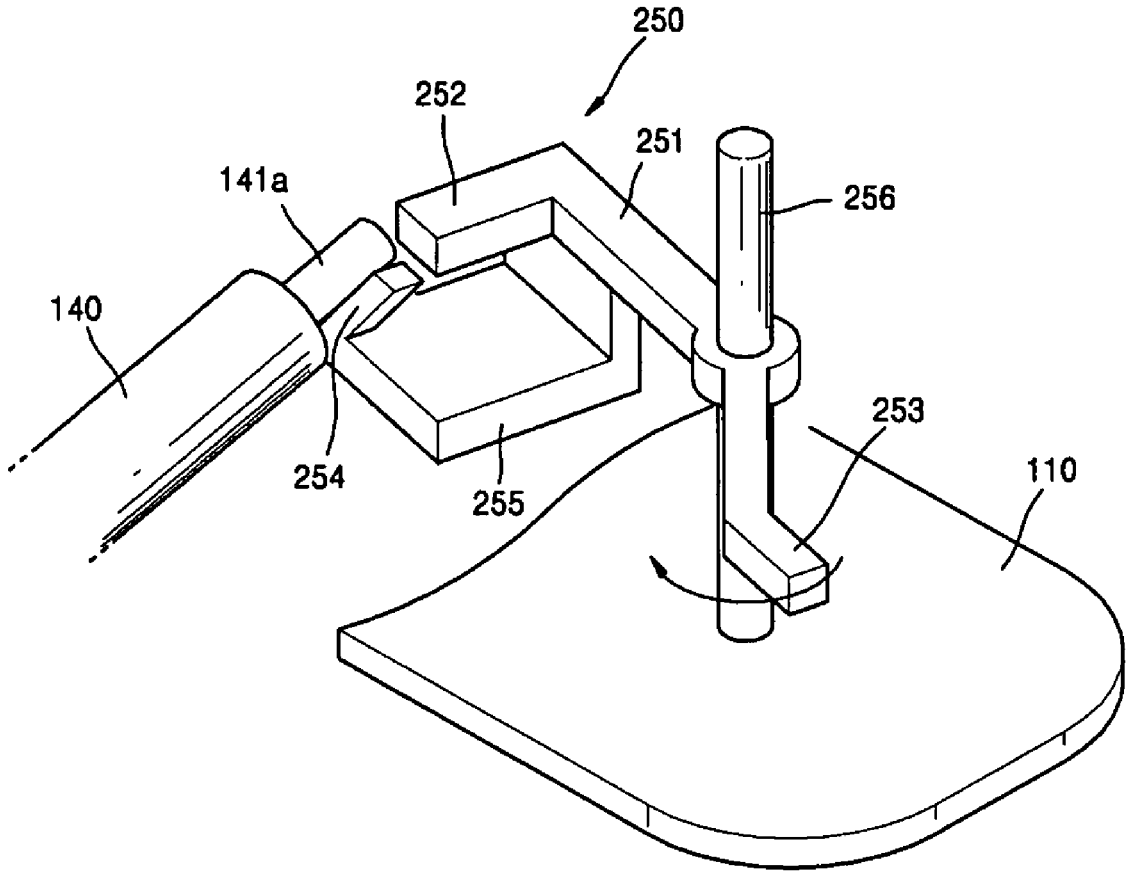

FIGS. 9 and 10 are perspective views illustrating attaching/detaching operations of an a device to attach/detach the transfer roller 140 according to another embodiment of the present invention.

Referring to FIGS. 9 and 10, a device 250 to attach/detach the transfer roller 140 according to another embodiment of the present invention comprises a supporting lever unit 251 and an elevation unit 255.

The supporting lever unit 251 is mounted to rotate with respect to the main body frame 110 by a rotation axis 256, and comprises a locking unit 252 on a side thereof to lock the end 141*a* of the transfer roller axis 141 and prevent it from moving upward, and an operation unit 253 disposed on the other side 141*b* thereof to be operated by user.

The elevation unit 255 is connected to the supporting lever unit 251, and comprises a slanting unit 254 provided to slant at a predetermined angle on a lower part of the locking unit 252.

The locking unit 252 and the slanting unit 254 are separated at a predetermined distance, and the distance is preferably large enough to insert therein the end 141*a* of the transfer roller axis 141.

An operation of the device 250 to attach/detach the transfer roller 140 according to another embodiment of the present invention will now be described.

An operation attaching the transfer roller 140 to the main body frame 110 will now be described with reference to FIG. 9. When the device 250 to attach/detach the transfer roller 140 is placed in a position indicated by dotted lines, the supporting lever unit 251 is turned in a counter clockwise direction after placing the end 141*a* of the transfer roller axis 141 on the slanting unit 254.

Then, the end 141*a* of the transfer roller axis 141 is inserted into the hemispherical supporting unit 112 by sliding downward along the slanting unit 254, and the movement in an upward direction is restricted by the locking unit 252.

An operation of separating the transfer roller 140 from the main body frame 110 will now be described by referring to FIG. 10. When the supporting lever unit 251 rotates in a clockwise direction, the end 141*a* of the transfer roller axis 141 positioned under the locking unit 254 is separated from the hemispherical supporting unit 112 by sliding in an upward direction along the slanting unit 254.

As described above, the transfer roller of an image-forming apparatus according to the present invention can be easily replaced from the main body frame using the device to attach/detach the transfer roller. Thus, high quality images can be obtained.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image-forming apparatus having a main body frame and a photosensitive medium on which a toner image is formed, the image-forming apparatus comprising:

a transfer roller that transfers the toner image onto a sheet of print medium; and a device to attach/detach the transfer roller to/from the main body frame;

wherein the device supports an end of a transfer roller axis to rotate with respect to the main body frame, and a motion of the device automatically separates/locks the end of the transfer roller axis from/to the main body frame by causing an ascending/descending of the end of the transfer roller axis in a direction.

2. The image-forming apparatus as claimed in claim 1, wherein the device is mounted to slide with respect to the main body frame.

3. The image-forming apparatus as claimed in claim 2, wherein the device slides in a print media transferring direction of the image-forming apparatus.

4. The image-forming apparatus as claimed in claim 2, wherein the device comprises:

a slanting unit; and a locking unit connected to the slanting unit comprising an open side so that the end of the transfer roller axis is insertable and fixable;

wherein the device separates the end of the transfer roller axis from the locking unit by ascending the end of the transfer roller axis up along the slanting unit by sliding with respect to the main body frame in a detaching direction and causing the end of the transfer roller axis to slide, and locks the end of the transfer roller axis to the locking unit by descending the end of the transfer roller axis down along the slanting unit by sliding with respect to the main body frame in a direction opposite to the detaching direction and causing the end of the transfer roller axis to slide.

5. The image-forming apparatus as claimed in claim 4, wherein the transfer roller axis slides along a print media transferring direction of the image-forming apparatus.

6. The image-forming apparatus as claimed in claim 4, wherein the open side of the locking unit faces the slanting unit.

7. The image-forming apparatus as claimed in claim 4, wherein the device further comprises a lever unit to allow a user to manipulate the device in a detaching or attaching operation.

8. The image-forming apparatus as claimed in claim 4, wherein the device further comprises a plurality of sliding protrusion units protruded on a side of the locking unit and sliding in a sliding hole provided on the main body frame.

9. The image-forming apparatus as claimed in claim 1, wherein the device is mounted to rotate with respect to the main body frame.

10. The image-forming apparatus as claimed in claim 9, wherein the device comprises:

a rotation axis rotatably mounted on the main body frame;

a supporting lever unit connected to the rotation axis and comprising a locking unit on a side of the supporting lever unit to support the end of the transfer roller axis by pressing the end of the transfer roller axis downward; and an elevation unit connected to the supporting lever unit and comprising a slanting unit slanted at a predetermined angle;

wherein the device separates the end of the transfer roller axis by ascending the end of the transfer roller axis along the slanting unit after the end of the transfer roller axis separates from the locking unit when the supporting lever rotates in a detaching direction, and locks the end of the transfer roller axis by descending the end of the transfer roller axis under the locking unit by descending along the slanting unit when the supporting lever rotates in a direction opposite to the detaching direction.

11. The image-forming apparatus as claimed in claim 10, wherein a gap is provided between the locking unit and the slanting unit, and the end of the transfer roller axis slides into the gap.

12. The image-forming apparatus as claimed in claim 10, wherein the device further comprises an operation unit to allow a user to manipulate the device in a detaching or attaching operation.

13. A device to attach/detach a transfer roller to/from a main body frame of an image-forming apparatus, wherein the device supports an end of a transfer roller axis to rotate with respect to the main body frame, and a motion of the device automatically separates/locks the end of the transfer roller axis from/to the main body frame by causing an ascending/descending of the end of the transfer roller axis in a direction.

14. The device as claimed in claim 13, wherein the device is mounted to slide with respect to the main body frame.

15. The device as claimed in claim 14, wherein the device slides in a print media transferring direction of the image-forming apparatus.

16. The device as claimed in claim 14, wherein the device comprises:

a slanting unit; and a locking unit connected to the slanting unit comprising an open side so that the end of the transfer roller axis is insertable and fixable;

wherein the device separates the end of the transfer roller axis from the locking unit by ascending the end of the transfer roller axis up along the slanting unit by sliding with respect to the main body frame in a detaching direction and causing the end of the transfer roller axis to slide, and locks the end of the transfer roller axis to the locking unit by descending the end of the transfer roller axis down along the slanting unit by sliding with respect to the main body frame in a direction opposite to the detaching direction and causing the end of the transfer roller axis to slide.

17. The device as claimed in claim 16, wherein the transfer roller axis slides along a print media feeding direction of the image-forming apparatus.

18. The device as claimed in claim 16, wherein the open side of the locking unit faces the slanting unit.

19. The device as claimed in claim 16, further comprising a lever unit to allow a user to manipulate the device in a detaching or attaching operation.

20. The device as claimed in claim 16, further comprising a plurality of sliding protrusion units protruded on a side of the locking unit and sliding in a sliding hole provided on the main body frame.

21. The device as claimed in claim 13, wherein the device is mounted to rotate with respect to the main body frame.

22. The device as claimed in claim 21, wherein the device comprises:

a rotation axis rotatably mounted on the main body frame;

a supporting lever unit connected to the rotation axis and comprising a locking unit on a side of the supporting lever unit to support the end of the transfer roller axis by pressing the end of the transfer roller axis downward; and an elevation unit connected to the supporting lever unit and comprising a slanting unit slanted at a predetermined angle;

wherein the device separates the end of the transfer roller axis by ascending the end of the transfer roller axis along the slanting unit after the end of the transfer roller axis separates from the locking unit when the supporting lever rotates in a detaching direction, and locks the end of the transfer roller axis by descending the end of the transfer roller axis under the locking unit by descending along the slanting unit when the supporting lever rotates in a direction opposite to the detaching direction.

23. The device as claimed in claim 22, wherein a gap is provided between the locking unit and the slanting unit, and the end of the transfer roller axis slides into the gap.

24. The device as claimed in claim 22, further comprising an operation unit to allow a user to manipulate the device in a detaching or attaching operation.

25. A method to attach/detach a transfer roller to/from a main body frame of an image-forming apparatus, the method comprising:

supporting an end of a transfer roller axis with a device; and automatically separating/locking the end of the transfer roller axis from/to the main body frame with a motion of the device by causing an ascending/descending of the end of the transfer roller axis on the device in a direction.

26. The method as claimed in claim 25, further comprising sliding the device to separate/lock the end of the transfer roller axis from/to the main body frame by ascending/descending the end of the transfer roller axis on the device in a slanting direction.

27. The method as claimed in claim 26, wherein the sliding is in a print media transferring direction of the image-forming apparatus.

28. The method as claimed in claim 26, further comprising:

separating the end of the transfer roller axis from a locking unit of the device by lifting the end of the transfer roller axis up along a slanting unit of the device by sliding the device with respect to the main body frame in a detaching direction and causing the end of the transfer roller axis to slide; and locking the end of the transfer roller axis to the locking unit by descending the end of the transfer roller axis down along the slanting unit by sliding the device with respect to the main body frame in a direction opposite to the detaching direction and causing the end of the transfer roller axis to slide.

29. The method as claimed in claim 28, wherein the transfer roller axis slides along a print media feeding direction of the image-forming apparatus.

30. The method as claimed in claim 28, wherein the open side of the locking unit faces the slanting unit.

31. The method as claimed in claim 25, further comprising rotating the device to separate/lock the end of the transfer roller axis from/to the main body frame by ascending/descending the end of the transfer roller axis on the device in a slanting direction.

32. The method as claimed in claim 31, further comprising:

separating the end of the transfer roller axis by ascending the end of the transfer roller axis along a slanting unit of the device after the end of the transfer roller axis separates from a locking unit of the device when a supporting lever of the device rotates in a detaching direction; and locking the end of the transfer roller axis by descending the end of the transfer roller axis along the slanting unit until it descends under the locking unit when the supporting lever rotates in a direction opposite to the detaching direction.

33. The method as claimed in claim 32, wherein the transfer roller axis slides along a print media feeding direction of the image-forming apparatus.

34. The method as claimed in claim 32, wherein a gap is provided between the locking unit and the slanting unit, and the end of the transfer roller slides into the gap.

* * * * *

UNITED STATES PATENT AND TRADEMARK OFFICE

CERTIFICATE OF CORRECTION

PATENT NO. : 7,606,513 B2
APPLICATION NO. : 11/387913
DATED : October 20, 2009
INVENTOR(S) : Hyun-ho Lee It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 512 days.

Signed and Sealed this

Twelfth Day of October, 2010

David J. Kappos

David J. Kappos
*Director of the United States Patent and Trademark Office*